US005355106A

United States Patent [19]

Nakata et al.

[11] Patent Number: 5,355,106

[45] Date of Patent: Oct. 11, 1994

[54] PULSE ELECTROMAGNET FOR APPARATUS FOR ACCUMULATING CHARGED PARTICLES

[75] Inventors: Shuhei Nakata; Chihiro Tsukishima, both of Amagasaki, Japan

[73] Assignee: Mitsubishi Denki Kabushiki Kaisha, Tokyo, Japan

[21] Appl. No.: 35,259

[22] Filed: Mar. 22, 1993

Related U.S. Application Data

[62] Division of Ser. No. 861,437, Apr. 1, 1992, Pat. No. 5,216,377, which is a division of Ser. No. 440,250, Nov. 22, 1989, Pat. No. 5,138,270.

[30] Foreign Application Priority Data

| | | | |
|---|---|---|---|
| Nov. 24, 1988 | [JP] | Japan | 63-294663 |
| Dec. 22, 1988 | [JP] | Japan | 63-322125 |
| Feb. 13, 1989 | [JP] | Japan | 1-31151 |
| Mar. 17, 1989 | [JP] | Japan | 1-65660 |

[51] Int. Cl.[5] ..... H01F 7/06

[52] U.S. Cl. ..... 335/212; 335/210

[58] Field of Search ..... 335/210–214; 328/228, 230, 233, 235; 250/396 ML; 336/137, 138, 145, 146, 192; 315/5.35

[56] References Cited

U.S. PATENT DOCUMENTS

| | | | |
|---|---|---|---|
| 2,837,638 | 6/1958 | Frink | 250/27 |
| 3,432,664 | 3/1969 | Robison | 250/98 |
| 4,482,816 | 11/1984 | Richardson et al. | 307/106 |

*Primary Examiner*—Leo P. Picard
*Assistant Examiner*—Raymond Barrera
*Attorney, Agent, or Firm*—Leydig, Voit & Mayer

[57] ABSTRACT

A coil structure of a pulse electromagnet designed to enable adjustment of the position at which a current supply cable is connected to current introducing terminals as well as to the adjustment of the attachment position of conductor rods for connecting return yoke members, thereby enabling the inductance of the coil to be easily changed.

5 Claims, 6 Drawing Sheets

PULSE ELECTROMAGNET FOR APPARATUS FOR ACCUMULATING CHARGED PARTICLES

This application is a division of application Ser. No. 07/861,437, filed Apr. 1, 1992 now U.S. Pat. No. 5,216,377, which is a division of application Ser. No. 07/440,250, filed Nov. 22, 1989, now U.S. Pat. No. 5,138,270.

BACKGROUND OF THE INVENTION

1. Field of the Invention

This invention relates generally to apparatus for accumulating charged particles and, more particularly, to a charged particle accumulator used as, for example, a light source for producing synchrotron radiation light.

2. Description of the Related Art

FIG. 1 schematically shows the construction of a conventional charged particle accumulator, such as the one described on p. 22 of TELL-TERAS ACTIVITY REPORT (1980~1986), which has a vacuum vessel 1 in the form of a ring, deflecting electromagnets 2, quadrupole electromagnets 3, a low speed pulse electromagnet 4, a high speed pulse electromagnet 5 and a high frequency cavity 6. These components are part of an accumulating ring. High speed electrons are generated by a linear electron accelerator 7.

FIG. 2 shows a locus of a charged particle in a phase plane at the outlet of the low speed pulse electromagnet 4. In FIG. 2, the abscissa X represents the deviation from the central orbital path and the ordinate X' represents the inclination of the charged particle beam from the center axis. A point 8 represents the position of an incident charged particle at the outlet of the low speed pulse electromagnet 4. A point 9 designates the state of the incident charged particle at the position of the high speed pulse electromagnet 5. A point 10 designates the state of the incident charged particle after the same has passed through the pulse electromagnet 5. A point 11 designates the state of the incident charged particle when the same returns to the position of the low speed pulse electromagnet 4. A point 12 represents the position of the incident particle having completed one revolution through the accumulating ring. Points 13 to 17 represent the positions of accumulated charged particles. A wall 18 represents a side wall of the low speed pulse electromagnet 4.

The conventional charged particle accumulator is thus constructed as explained above. The motion of charged particles at the time of introduction will be explained below. Electrons generated by the linear electron accelerator 7 are deflected by the low speed pulse electromagnet 4 so that each electron reaches a state represented by the point 8 in FIG. 2. When the electron comes to the high speed pulse electromagnet 5, the position of the electron in the phase plane is as represented by the point 9. At this time, the inclination of the electron is changed in a step manner by the vertical magnetic field produced by the high speed pulse electromagnet 5 so that the state of the electron is changed to that represented by the point 10. When the electron thereafter comes to the low speed pulse electromagnet 4 again, the position of the electron is at the point 11. When the electron thereafter comes to the low speed pulse electromagnet 4 by undergoing the above-described effect over again, the position of the electron is at the point 12. The electron moves in the phase plane by repeating this cycle. If the electron does not collide with the side wall 18 until the magnetic field of the high speed pulse electromagnet 5 is extinguished, the electron introduced from outside is considered to be stored in the accumulator. On the other hand, the positions of other electrons already stored move successively from the point 13 to the point 17 as they undergo the same effect.

This process will be explained below in more detail. The pulse electromagnet 5 produces, in the orbital path for the charged particle beam, a magnetic field in the vertical direction alone to deflect the charged particle beam path to a certain extent. The need for the pulse electromagnet 5 is based on the following reason. In a case where only a magnetic field that is constant with respect to time acts on the beam, the beam proceeds along a line such as that represented by the circular arc concentric with the center axis of the phase plane of FIG. 2. That is, the beam proceeds along the circular arc passing through the point 8 as indicated by the broken line in FIG. 2, and thereafter returns to the position of the point 8. In this case, however, the beam cannot be introduced because it collides with the side wall 18 of the low speed pulse electromagnet 4. To maintain the introduced beam inside the accumulator, it is necessary to deflect for only a certain period of time the orbital path of the beam with the pulse electromagnet 5. If the current for the pulse electromagnet 5 is shut off, for example, after the introduced beam has been changed to the position of the point 10, the beam thereafter proceeds in accordance with a circular arc concentric with the center axis of FIG. 2, as indicated by the broken line passing through the point 10. Thus, the introduced beam traces the orbital path located inside the first position in FIG. 2 and does not deviate outwardly from this path.

This conventional charged particle accumulator entails various problems in that 1) the orbital paths for stored charged particles are disturbed because the high speed pulse electromagnet 5 uniformly produces a vertical magnetic field;

2) the capacity of the power source for the high speed pulse electromagnet is large because the space to be filled with the magnetic field produced is large;

3) The next charged particles to be stored cannot be introduced until the changed orbital paths for the stored charged particles are restored;

4) the accumulator cannot be used as a synchrotron radiation light source during charge particle introduction;

5) introduced charged particles collide with the side wall of the low speed pulse electromagnet unless the pulse width for the high speed pulse electromagnet is sufficiently short;

6) a further increase in the power source capacity is therefore required; and 7) introduced charged particles pass through a point at a large distance from the central orbital path, so it is necessary to increase the effective range of the magnetic field of each of the deflection and the quadrupole electromagnets of the accumulating ring.

SUMMARY OF THE INVENTION

In view of these problems, an object of the present invention is to provide a charged particle accumulator having a high speed pulse electromagnet for introducing incident charged particles without disturbing stored charged particles and operating with pulses having a longer pulse width and with a power source having a longer capacity, the charged particle accumulator being capable of being used as a light source while introducing charged particles.

The present invention provides a changed particle accumulator having a high speed pulse electromagnet for producing magnetic field components of at least four poles.

In accordance with the present invention, the directions of magnetic fields produced by the high speed pulse electromagnet are opposite to each other and symmetrical about the center axis. The intensity of the magnetic field is proportional to the distance from the center axis (proportional to x in the phase plane of FIG. 4). As a charged particle introduced from the outside deviates from the center axis, the magnetic field force acting on the charged particle becomes greater, and the charged particle is thereby forced back to the center axis. The position of charged particle as represented in the phase plane each time the particle makes one revolution is symmetrical about the origin with the previous position (in a certain straight line passing through the origin). The charged particle is thereby converged to the center axis of the beam path.

The present invention provides in its second aspect a power surface circuit for the pulse electromagnet, i.e., a high voltage pulse generator circuit capable with generating pulses of a reduced rise time while being supplied with charging current at a low voltage. The present invention also provides in its third aspect a coil structure for the pulse electromagnet in which the inductance of the coil can be easily changed to control the rise time of the pulse magnetic field.

DESCRIPTION OF THE PREFERRED EMBODIMENTS

Figure 1:
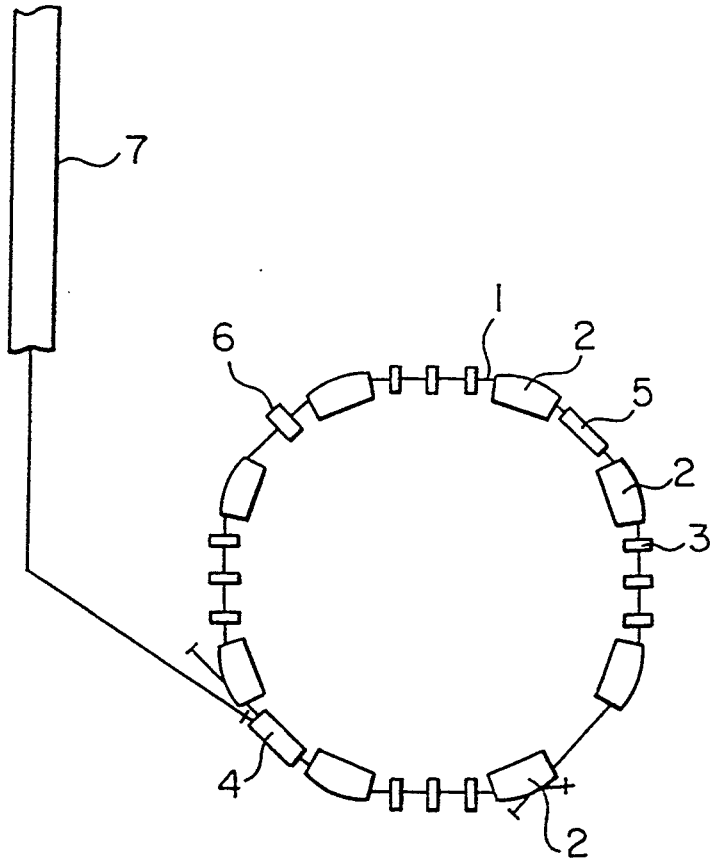
FIG. 1 PRIOR ART
FIG. 1 is a schematic plan view of a conventional charged particle accumulator.
Figure 2:
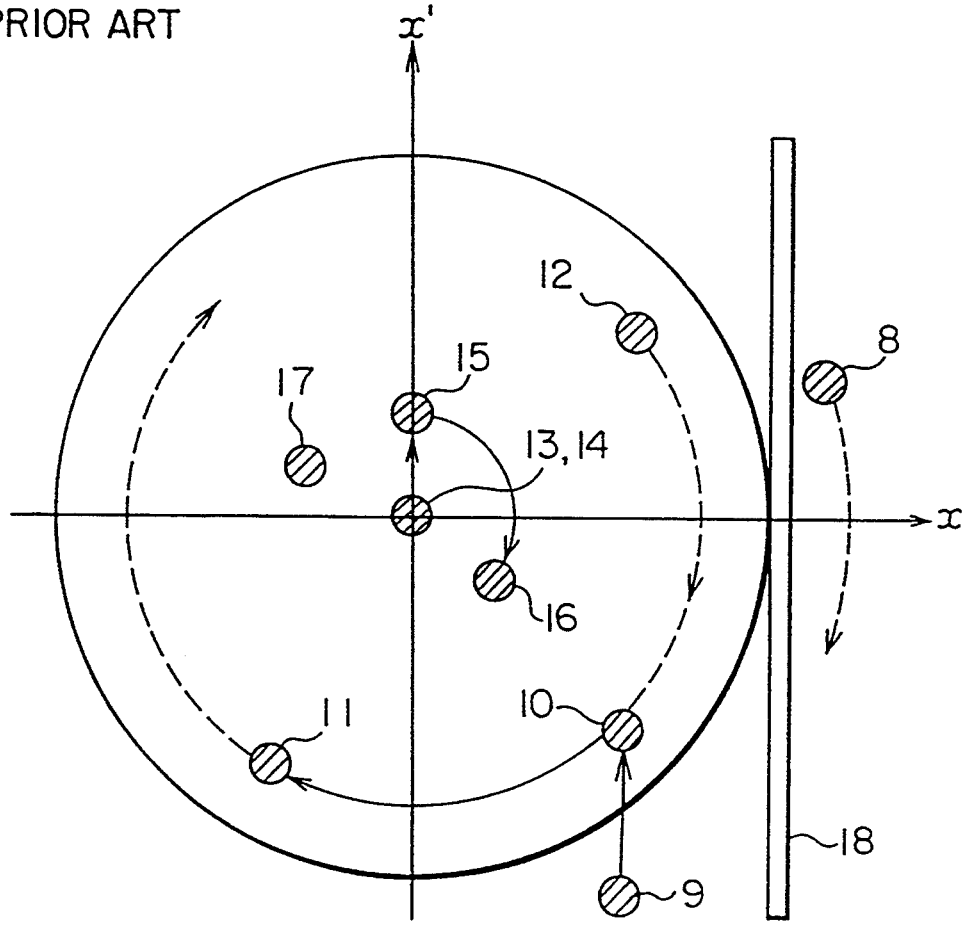
FIG. 2 PRIOR ART
FIG. 2 is a diagram showing in a phase plane the motions of charged particles in the accumulator shown in FIG. 1.
Figure 3:
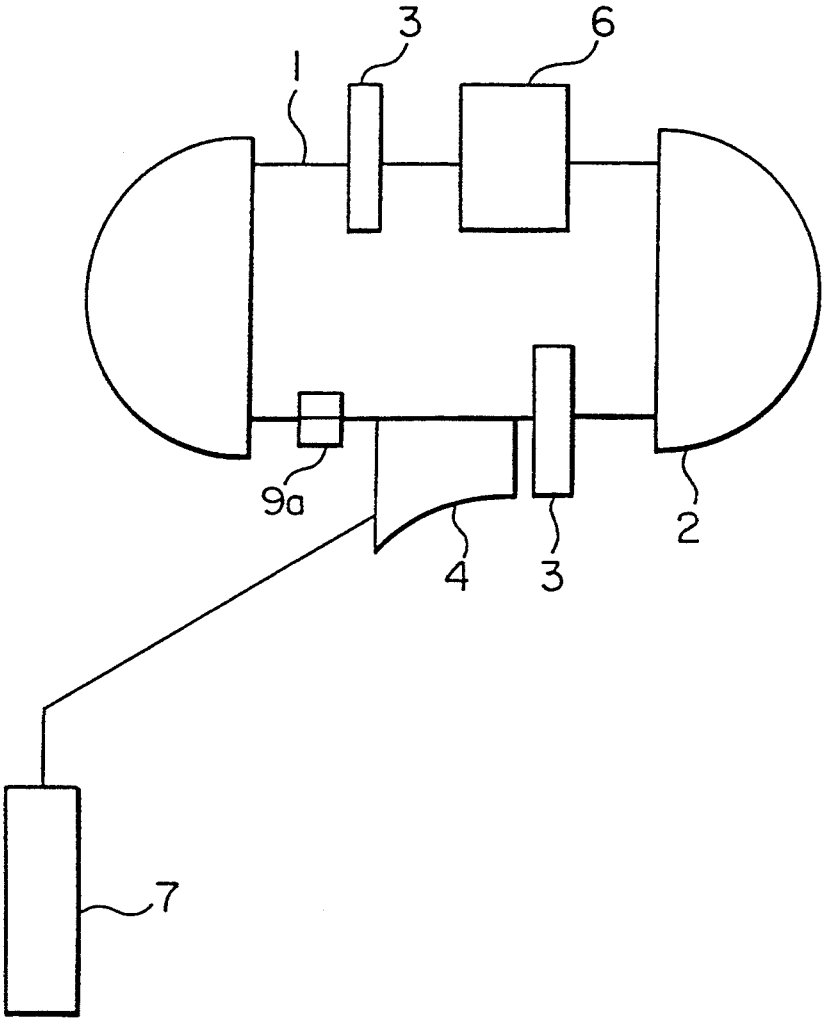
FIG. 3 is a schematic plan view of a charged particle accumulator in a first aspect of the present invention.
Figure 3A:
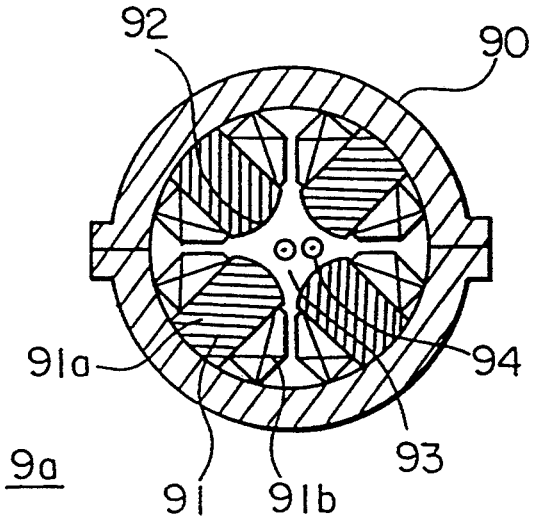
FIG. 3A is a transverse sectional view of an embodiment of the high speed pulse electromagnet of the accumulator shown in FIG. 3.

FIG. 3 is a schematic plan view of a charged particle accumulator which represents an embodiment of the present invention. A high speed pulse electromagnet 9*a* produces a quadrupole magnetic field. Other components are identical to those indicated by the same reference characters in FIG. 1. FIG. 3A shows an embodiment of the high speed pulse electromagnet 9*a* in transverse cross section. A quadrupole electromagnet 91 for generating a quadrupole magnetic field is disposed inside a yoke 90. The quadrupole electromagnet 91 comprises four electromagnets each of which includes a core 91*a* and a coil 91*b*. Each of these electromagnets produces a magnetic field directed toward the center of a vacuum vessel 92. Points 93 and 94 shown inside the vacuum vessel 92 represent the position of a stored charged particle and the position of an incident charged particle, respectively.

Figure 4:
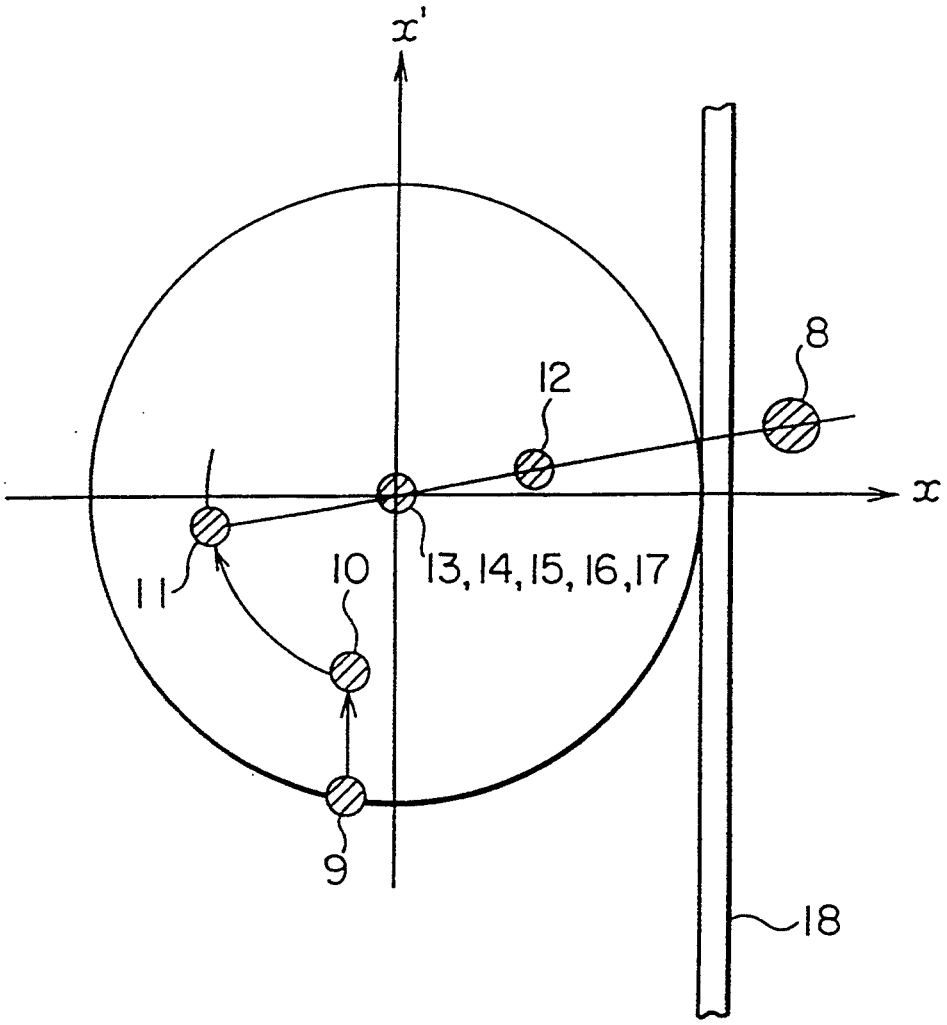
FIG. 4 is a diagram showing in a phase plane the motions of charged particles in the accumulator shown in FIG. 3.

FIG. 4 shows a locus of a charged particle in a phase plane at the outlet of a low speed pulse electromagnet 4. In FIG. 4, a point 8 represents the position of an incident charged particle at the outlet of the low speed pulse electromagnet 4. A point 9 designates the state of the incident charged particle at the position of the high speed pulse electromagnet 9*a*. A point 10 designates the state of the incident charged particle after the same has passed through the high speed pulse electromagnet 9*a*. A point 11 designates the state of the incident charged particle that has returned to the position of the low speed electromagnet 4. A point 12 represents the position of the incident particle when the particle completes one revolution through the accumulating ring. Points 13 to 17 represent the positions of loci of accumulated charged particles. A wall 18 represents a side wall of the low speed pulse electromagnet 14.

In the accumulator thus constructed, the electrons generated by the linear electron accelerator 7 are deflected by the low speed pulse electromagnet 4 so that each electron comes into a state such as that represented by the point 8 in FIG. 4. When the electron comes to the high speed pulse electromagnet 9*a*, the position of the electron in the phase plane is as represented by the point 9. At this time, the inclination of the electron is changed in a step manner by the vertical magnetic field produced by the high speed pulse electromagnet 9*a* so that the state of the electron is changed to that represented by the point 10. The position of the point 11, reached by the electron when the electron comes to the low speed pulse electromagnet 4 again, can be brought to a position symmetrical with the point 8 about the origin if the strength of the magnetic field produced by the high speed pulse electromagnet 9*a* is suitably selected. If the current flowing through the high speed pulse electromagnet 9*a* is a rectangular wave current, the introduced charged particle can always move along the straight line connecting the point 8 and the origin, since the intensity of the magnetic field produced by the high speed pulse electromagnet 9*a* is proportional to the distance to the center. When the electron thereafter comes to the low speed pulse electromagnet 4 by undergoing the same effect, the position of the electron reaches the point 12. The electron moves for convergence to the origin in the phase plane by repeating this cycle. Thus, the introduced charged particle can be stored in the ring without being lost, even if the large pulse width for the high speed pulse electromagnet 9*a* is increased. On the other hand, the positions of charged particles already stored are in the vicinity of the origin; they are not influenced by the high speed pulse electromagnet 9*a* because the intensity of the magnetic field produced by the high speed pulse electromagnetic 9a is substantially zero.

In this embodiment, the quadrupole electromagnet is used as a high speed pulse electromagnet. However, the same effects can be expected even in a case where a multipole electromagnet capable of producing a magnetic field of a higher order is used.

In this embodiment, a rectangular wave current is used as the current for the high speed pulse electromagnet, but the same effects can also be expected by using a different current having, e.g., a damped oscillation wave, a sine half wave or a triangular wave.

In the first aspect of the present invention, as described above, a multipole electromagnet is used in place of the conventional high speed pulse electromagnet for producing a vertical magnetic field, thereby enabling charged particles to be introduced from the outside without any considerable influence upon the stored particles. The described embodiment also achieves a reduction in the extent of divergence of introduced charged particles and thereby makes it possible to reduce the effective ranges of the magnetic fields of the deflecting electromagnet and the quadrupole electromagnet of the accumulating ring and, hence, to reduce the size of each electromagnet.

The present invention relates in a second aspect to a power supply circuit for pulse electromagnets or, more specifically, for the high speed pulse electromagnet, i.e., a high voltage pulse generator circuit for generating pulses with a short rise time while being supplied with a low charging voltage.

Figure 5:
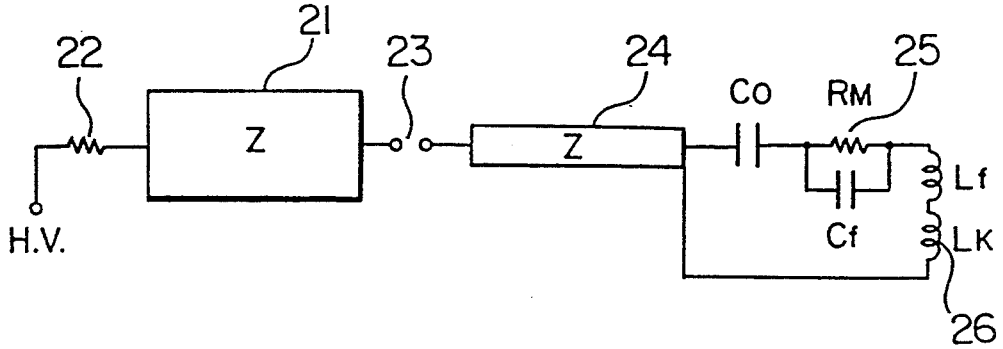
FIG. 5 PRIOR ART
FIG. 5 is a circuit diagram of a conventional high voltage pulse generator.

FIG. 5 shows a circuit diagram of a conventional high voltage pulse generator described in the thesis "Experiment of Fast Electron Extraction System" written by S. Nakata and made public in IEEE Proceedings of Particle Accelerator Conference. A DC power source represented by H.V. is connected by a charging resistor 22 to one end of a pulse forming network (PFN) type charge circuit 21 having an impedance Z. The other end of the charge circuit 21 is connected to a transmission line 24 via a switching device 23, e.g., a thyratron. The transmission line 24 has an impedance Z and is, for example, a coaxial cable. A matching resistor 25 having a resistance $R_M$ and a load, e.g., a pulse coil 26 of a kicker magnet (not shown) are connected in series between the inner and outer conductors of the transmission line at the load end thereof. $C_f$ in parallel with the matching resistor 25 represents a stray capacitance, and $C_O$ in series therewith represents a series capacitance. The pulse coil 26 having an inductance $L_k$ creates a stray inductance $L_f$ in series.

Before the thus-constructed high voltage pulse generator is started, the switching device 23 is maintained in the off state. Accordingly, the PFN charge circuit 21 is charged at a voltage V by the DC power source H.V. When the switching device 23 is switched on, the electric charge accumulated in the PFN charge circuit 21 is supplied to the matching resistor 25 and to the pulse coil 26 via the switching device 23 and the inner conductor of the transmission line 24, and returns to the switching device 23 via the outer conductor. The electric charge is released to ground (not shown) at the switching device 23.

At this time, if the time taken for pulse transmission through the PFN charge circuit 21 is T, pulses of a pulse width of 2T are supplied to the transmission line 24 at a voltage of V/2, provided that the PFN charge circuit 21 and the transmission line have equal impedances, i.e., Z as shown in FIG. 5.

The rise of the current flowing through the pulse coil 26 is expressed by the following equation:

$$I = I_O\left(1 - e^{\frac{-(L_f + L_k)}{R_M} t}\right)$$

where $I_O$ is a stationary state value of the current I and is expressed by $$I_O = \frac{1}{2} \cdot \frac{V}{RM}.$$

To reduce the current I rise time, it is necessary to increase the resistance $R_M$ of the matching resistor 25 or to reduce the size of the pulse coil 26 so as to reduce $(L_f+L_k)$ in the above equation. Since $(L_f+L_k)$ and $I_O$ are generally determined by the required size of the pulse coil 26 and the required intensity of the magnetic field produced, the circuit is ordinarily designed to set a larger value of $R_M$. Consequently, to reduce the current I rise time, it is necessary to increase the charging voltage since the voltage V of the DC power source H.V. is equal to $2R_M \cdot I_O$. The design for increasing the charging voltage to obtain pulses with a shorter rise time results in an increase in the manufacturing cost of the circuit and is also disadvantageous in terms of electrical insulation.

The present invention aims in its second aspect to solve this problem by using a high voltage pulse generator in which the charging voltage can be set to a lower level.

In the second aspect of the present invention, at least one Blumlein type charge circuit having a pair of coaxial cables connected in parallel and each having an impedance of Z/2 is used instead of the PFN charge circuit having an impedance Z. Pulses having a voltage V equal to the dc power supply voltage or a voltage of 2 V are thereby supplied to the pulse coil. That is, the charging voltage can be reduced to ½ or ¼ of that in the case of the conventional generator.

Figure 6:
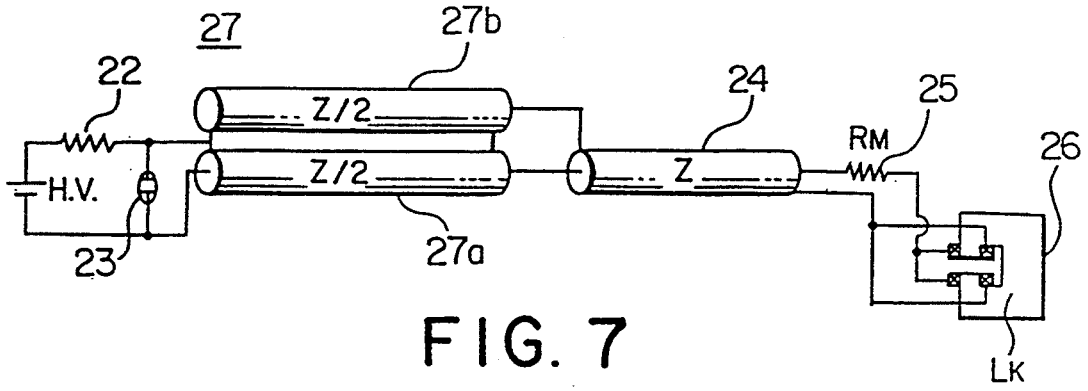
FIGS. 6, 7, and 8 are, respectively, circuit diagrams of first, second, and third embodiments of a high voltage pulse generator according to a second aspect of the present invention.

FIG. 6 shows a circuit of a first embodiment of the high pressure voltage generator provided in a second aspect of the present invention. Components 22 to 26 are equivalent to those shown in FIG. 5. In accordance with the present invention in its second aspect, a Blumlein type charge circuit 27 is provided which consists of, for example, a pair of coaxial cables 27a and 27b connected in parallel and each having an impedance of Z/2. At the power supply end of the Blumlein charge circuit 27, the inner conductor of the coaxial cable 27a is connected to a minus terminal of the DC power source H.V. and a point of connection between the outer conductors of the coaxial cables 27a and 27b is connected to the plus terminal of the DC power source H.V. via the charging resistor 22. The switching device 23 is connected between the minus terminal and the-outer terminal connection point. At the load end of the Blumlein charge circuit 27, the inner conductor of the coaxial cable 27a is connected to the inner conductor of the transmission line 24 while the inner conductor of the coaxial cable 27b is connected to the outer conductor of the transmission line 24.

In the first embodiment thus-constructed, the switching device 23 is first maintained in the off state, and the Blumlein charge circuit 27 is charged to a voltage V by the DC power source H.V. When the switching device 23 is switched on, the electric charge accumulated in the Blumlein charge circuit 27 is supplied as pulses at the voltage V to the pulse coil 26 via the transmission line 24 and the matching resistor 25.

Figure 7:
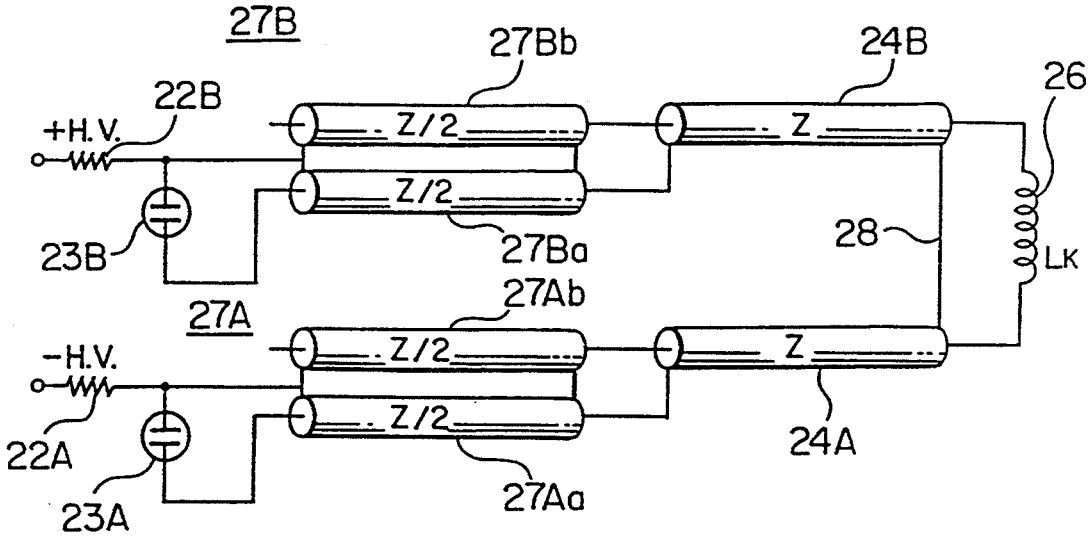

FIG. 7 shows a circuit of a second embodiment of the high voltage pulse generator of the present invention which includes a pair of DC power sources +H.V. and −H.V., a pair of charging resistors 22A and 22B, a pair of switching devices 23A and 23B, a pair of Blumlein charge circuits 27A and 27B and a pair of transmission lines 24A and 24B while eliminating the need for the matching resistor 25. The Blumlein charge circuit 27A consists of a pair of coaxial cables 27Aa and 27Ab connected in parallel and each having an impedance of Z/2. At the power supply end of the Blumlein charge circuit 27A, the inner conductor of the coaxial cable 27Aa is connected to the DC power source −H.V. via the switching device 23A and the charging resistor 22A, and a point of connection between the outer conductors of the coaxial cables 27Aa and 27Ab is connected to the DC power source −H.V. via the charging resistor 22A. At the load end of the Blumlein charge circuit 27A, the inner conductor of the coaxial cable 27Aa is connected to the outer conductor of the transmission line 24A while the inner conductor of the coaxial cable 27Ab is connected to the inner conductor of the transmission line 24A. The DC power source +H.V., the charging resistor 22B, the switching device 23B, the Blumlein charge circuit 27B and the transmission line 24B are connected in the same manner. At the load end of the transmission lines 24A and 24B, the pulse coil 26 is connected between the inner conductors while the outer conductors are connected to each other by a conductor 28.

In the second embodiment thus-constructed, the switching device 23A is first maintained in the off state, and the Blumlein charge circuit 27A is charged at a voltage −V by the DC power source −H.V. At the same time, the switching device 23B is first maintained in the off state, and the Blumlein charge circuit 27B is charged at a voltage +V by the DC power source +H.V. When the switching devices 23A and 23B are switched on, the electric charge accumulated in the Blumlein charge circuits 27A and 27B is supplied as pulses at a voltage of $V-(-V)=2$ V to the pulse coil 26 via the transmission line 24A and 24B. This effect means that the charging voltage can be reduced to $\frac{1}{4}$ of that in the case of the conventional generator. In the second example, the impedances of the transmission lines 24A and 24B on the side of the load are each Z and satisfy the matching condition, and there is therefore no need for any matching resistor.

Figure 8:
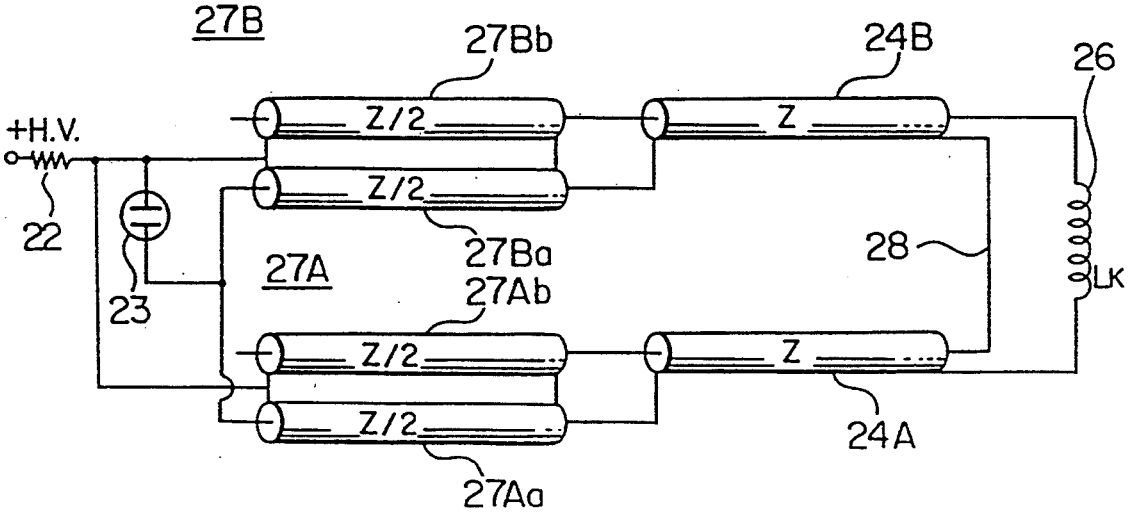

FIG. 8 shows a circuit of a third embodiment of the high voltage pulse generator of the present invention. The components thereof are generally the same as those of the second embodiment except that the third example makes use of only one dc power source and only one switching device. At the power supply end of the Blumlein charge circuits 27A and 27B, the inner conductor of the coaxial cable 27Aa of the Blumlein charge circuit 27A and the inner conductor of the coaxial cable 27Ba of the Blumlein charge circuit 27B are connected together and are then connected to the DC power source +H.V. via the switching device 23 and the charging resistor 22. Also, a point of connection between the outer conductors of the coaxial cables 27Aa and 27Ab of the Blumlein charge circuit 27A connected in parallel and a point of connection between the outer conductors of the coaxial cables 27Ba and 27Bb of the Blumlein charge circuit 27B connected in parallel are connected together and are then connected to the DC power source +H.V. via the charging resistor 22. At the load end of the transmission lines 24A and 24B, the outer conductor of the transmission line 24A and the inner conductor of the transmission line 24B are connected through the pulse coil 26 while the inner conductor of the transmission line 24A and the outer conductor of the transmission line 24B are connected by a conductor 28.

In the third embodiment thus-constructed, the switching device 23 is first maintained in the off state, and both the Blumlein charge circuits 27A and 27B are charged at a voltage +V by the DC power source +H.V. When the switching device 23 is switched on, the electric charge accumulated in the Blumlein charge circuits 27A and 27B is supplied as pulses at a voltage of $V+V=2$ V to the pulse coil 26 via the transmission line 24A and 24B.

In these embodiments, coaxial cables are used for the Blumlein charge circuits, but charge lines each having an impedance of Z/2 may be used instead of the coaxial cables to obtain the same effects.

In accordance with the present invention in its second aspect, at least one Blumlein charge circuit consisting of a pair of coaxial cables or charge lines connected in series and each having an impedance of Z/2, thereby enabling simplification of the construction while ensuring that pulses can be supplied to the pulse coil at a voltage v equal to the dc power supply voltage or a voltage of 2 V and that the charging voltage can be reduced to $\frac{1}{2}$ or $\frac{1}{4}$ of that of the conventional generator.

The present invention relates in its third aspect to a pulse electromagnet unit or, more specifically, a high speed pulse electromagnet unit.

Figure 9:
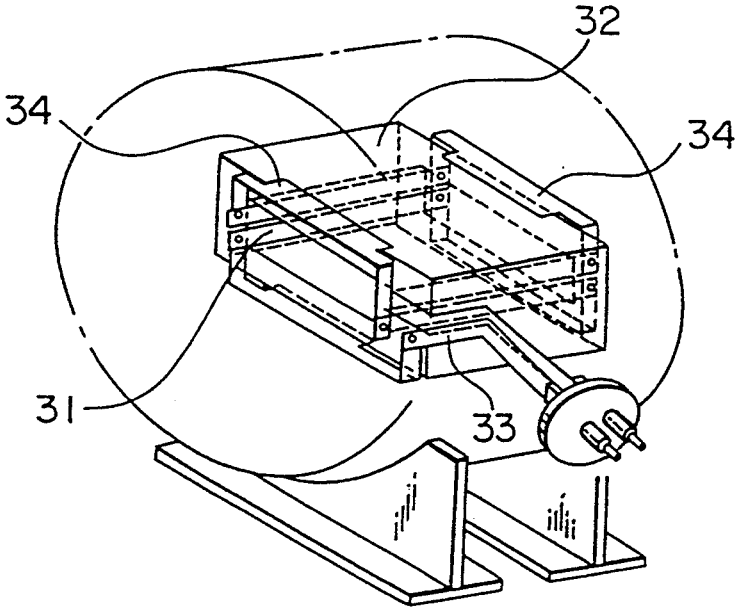
FIG. 9 PRIOR ART
FIG. 9 is a perspective view of a conventional pulse electromagnet unit.

FIG. 9 shows the structure of a conventional pulse electromagnet unit such as the one described in UVSR-7 "Design for Incidence Synchrotron" issued from Bunshi Kagaku Kenkyojo in March, 1981.

A cavity is formed in a core 32 at the center thereof so as to transversely extend through the core 32, two pairs of plate coils extend along two sides of this cavity. For the formation of magnetic paths, each of opposite ends of one plate coil 31 is connected by one of yokes 34 to one end of the upper or lower plate coil 31 on the opposite side of the cavity. The four plate coils are successively connected in series. Two terminals of these series plate coils 31 are connected to current introducing terminals 33 through which the coils are supplied with a current. A magnetic field is excited in the cavity of the core 32 when a current flows through the current introducing terminals 33. The time constant of the rise of this magnetic field is the ratio of the inductance L of the coil and the resistance R of the load (L/R). In this case, it is required to equalize the impedance Z of the power source and the transmission line and the resistance R of the load to enable a pulse current supplied from the power source through the current introducing terminals 33 to be transmitted to the load without being reflected by the current introducing terminals.

In the conventional pulse electromagnet unit, the plate coils 31, the return yokes 34 and the terminals 3 are fixedly attached and the inductance L of the coil is therefore constant. To change the rise time of the magnetic field of this electromagnet, it is necessary to change the impedance of the power source according to the relationship of the resistance R and the inductance L. It is therefore difficult to obtain a waveform for the optimum change in the magnetic field with time for the deflection of the orbital path.

A pulse electromagnet unit provided in a third aspect of the present invention has a structure in which the positions of power supply lines and conductor rods attached to return yokes and current introducing terminals can be adjusted. The rise time of the produced pulse magnetic field can be easily controlled by adjusting the attachment positions and, hence, the total inductance of the electromagnet.

An embodiment of the pulse electromagnetic unit of the present invention will be described below with reference to FIGS. 10 and 10A.

Figure 10:
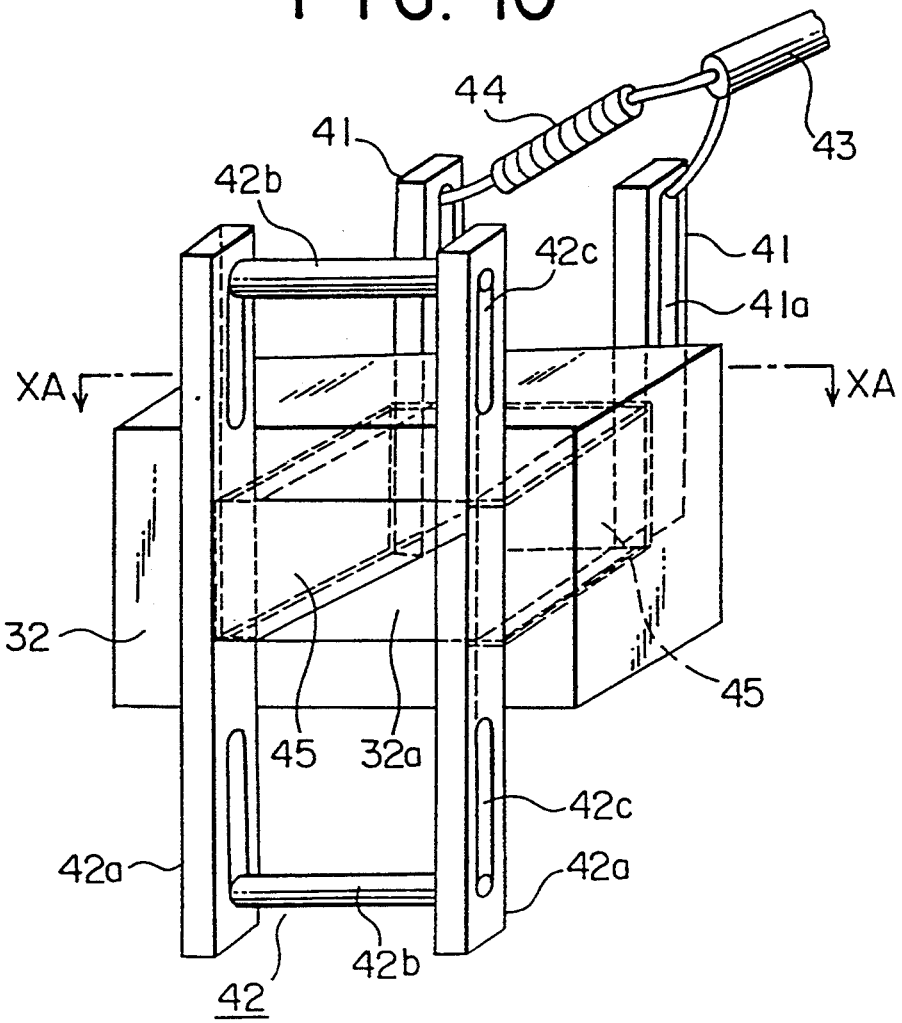
FIG. 10 is a perspective view of the coil structure of an embodiment of a pulse electromagnet unit in a third aspect of the present invention.
Figure 10A:
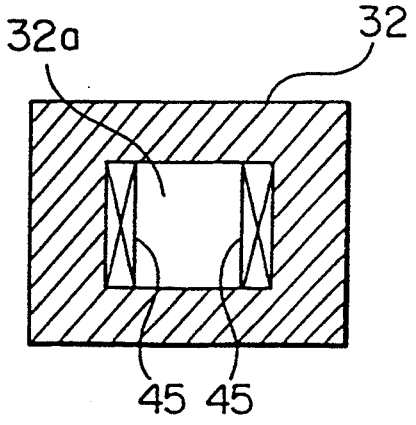
FIG. 10A is a cross-sectional view taken along the line XA—XA of FIG. 10.

Referring to FIG. 10, a pair of elongated current introducing terminals 41 extending in the vertical direction are disposed on one side of a core 32. Elongated grooves 41*a* for attachment of current introducing conductors, i.e., conductors of a transmission line 43, for supplying the electromagnet with a current are respectively formed in the current introducing terminals 41, thereby making it possible to change the current introduction positions in the vertical direction. A return yoke assembly 42 for forming magnetic paths is disposed on the side of the core 32 remote from the current introducing terminals 41. The return yoke assembly 42 has elongated return yoke members 42*a* extending in the vertical direction, and elongated grooves 42*c* for attachment of conductor rods 42*b* for connecting the return yoke members 42*a* are respectively formed in upper and lower end portions of the return yoke members 42*a*. In this construction, the attachment positions of the conductor rods 42*b* can be adjusted in the vertical direction. A pair of plate coils 45 respectively extend on opposite sides of a cavity 32 formed in the core 32, as also shown in FIG. 10A in section. Each plate coil 45 is connected at its one end to one of the current introducing terminals 41 and at the other end to the corresponding return yoke member 42*a*. The transmission line 43 is formed of a coaxial cable having an inner conductor connected to one of the current introducing terminals and an outer conductor connected to the other terminal. A resistor 44 is inserted in a portion of the inner conductor. The current flows from one of the terminals 41 to one of the return yoke members 42*a* through the plate coil 45 connected therebetween, passes to the return yoke member 45*a* through the two conductor rods 42*b* connected between the opposite end portions of the return yoke members 42*a*, and flows to the other terminal 41 through the other plate coil 45.

Generally, the inductance L of a coil includes a factor determined by the area encircled by the coil. The attachment positions of the transmission line 43 and the two conductor rods 42*b* may therefore be changed in the vertical direction along the grooves 41*a* of the current introducing terminals 41 and the return yoke members 42*a* positioned at the opposite ends of the plate coils 45 to change the area encircled by the coil and, hence, to adjust the inductance L of the coil to the desired value. Control of the rise time of the magnetic field produced can be achieved on the basis of the adjustment of the inductance, thereby enabling the control of the waveform of the produced magnetic field.

The above-described embodiment is designed to change in the vertical direction the positions of the transmission line 43 and the conductor rods 42 attached to the current introducing terminals 41 and the return yoke assembly 42. However, the present invention is not limited to this and another construction may be adopted in which the attachment positions can be changed in the direction in which the plate coils extend, i.e., the axial direction of the cavity.

Figure 11:
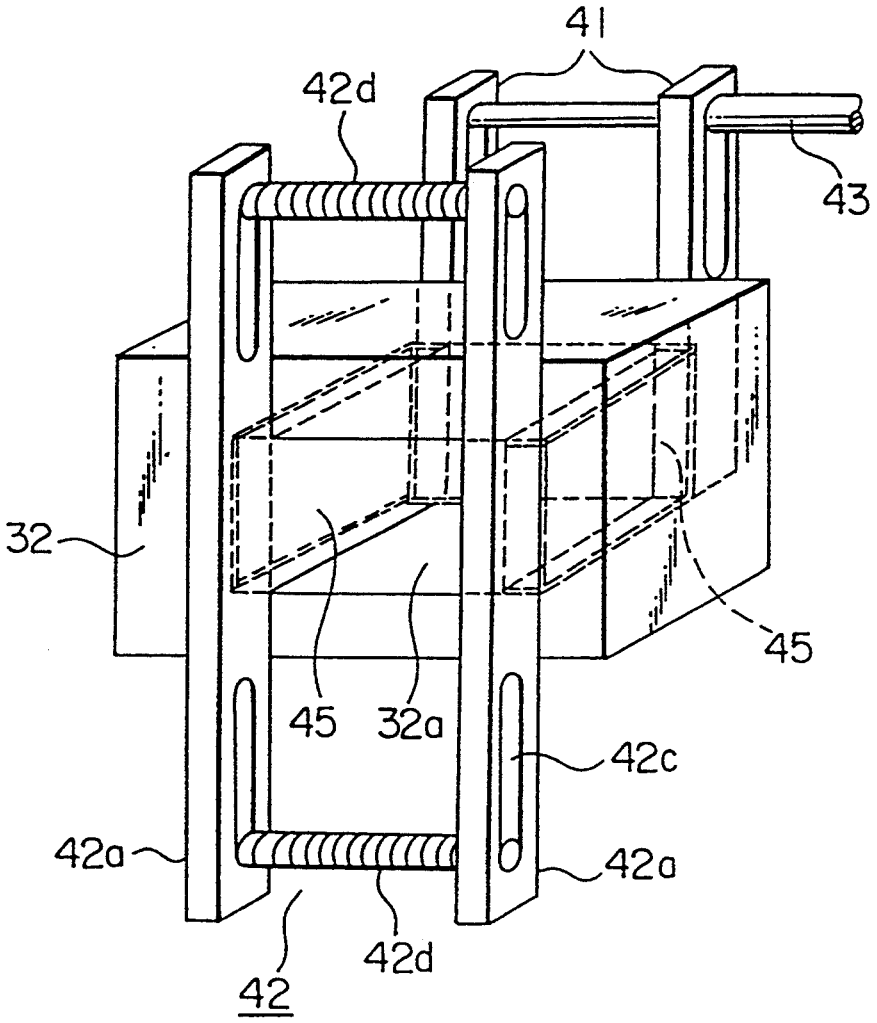
FIG. 11 is a perspective view of another embodiment of the pulse electromagnet unit in a third aspect of the present invention.

Also, as shown in FIG. 11, resistors 42*b* may be directly used in place of the conductor rods 42*d* of the return yoke assembly 42 shown in FIG. 10. In this case, an effect of reducing the unnecessary stray inductance can be obtained along with the adjustment function.

What is claimed is:

1. A pulse electromagnet unit for supplying a pulsed magnetic field to a charged particle beam in a charged particle accumulator to change the orbital path of the charged particles, said electromagnet unit comprising:

a transmission line for supplying an exciting current;

a core having a cavity extending along a center axis and having an opening at each of two faces;

a pair of elongated current introducing terminals disposed on opposite sides of the opening of the cavity, said current introducing terminals having elongated grooves for selectively attaching said transmission line at positions along the grooves in said current introducing terminals;

a return yoke assembly having a pair of elongated return yoke members disposed on opposite sides of the opening of the cavity, two conductor rods for electrically connecting opposite end portions of said pair of return yoke members, and elongated grooves in opposite end portions of said return yoke members for selectively attaching said conductor rods along the grooves in said return yoke members; and a pair of plate coils extending through the cavity of said core along a pair of opposite inner surfaces of said core, each of said plate coils being connected at one end to one of said pair of current introducing terminals and at another end to one of said pair of return yoke members whereby the rise time of the pulsed magnetic field produced can be changed by selecting the attachment positions of said transmission line and said conductor rods, thereby selecting the coil inductance.

2. A pulse electromagnet unit according to claim 1 wherein said current introducing terminals, said return yoke members, and the grooves in said current introducing terminals and said return yoke members extend in a direction generally perpendicular to said plate coils.

3. A pulse electromagnet unit according to claim 1, wherein a matching resistor is inserted in said transmission line connected to said pair of current introducing terminals.

4. A pulse electromagnet unit according to claim 1, wherein resistors are used as said two conductor rods connecting opposite end portions of said pair of return yoke members to reduce the stray inductance.

5. A pulse electromagnet unit according to claim 1 wherein said transmission line is a coaxial cable.

* * * * *